US006398602B2

(12) United States Patent
Watanabe

(10) Patent No.: US 6,398,602 B2
(45) Date of Patent: Jun. 4, 2002

(54) INTAKE DEVICE OF OUTBOARD MOTOR

(75) Inventor: Toshio Watanabe, Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/729,964

(22) Filed: Dec. 6, 2000

(30) Foreign Application Priority Data

Dec. 8, 1999 (JP) ..... 11-348975

(51) Int. Cl.[7] ..... B63H 21/32
(52) U.S. Cl. ..... 440/88; 440/89
(58) Field of Search ..... 440/89, 88

(56) References Cited

U.S. PATENT DOCUMENTS 6,030,262 A * 2/2000 Okamoto et al. ..... 123/495
6,325,046 B1 * 12/2001 Kanno ..... 123/406.44

* cited by examiner

*Primary Examiner*—Jesus D. Sotelo
(74) *Attorney, Agent, or Firm*—Oblon, Spivak, McClelland, Maier & Neustadt, P.C.

(57) ABSTRACT

An outboard motor is provided with an intake device, in which a throttle body is connected to an upstream side of an intake manifold connected to an intake port formed in a cylinder head of an outboard motor engine and a silencer is connected to an upstream side of the throttle body. A noise reduction device is further disposed between a connecting portion of the throttle body and the silencer.

8 Claims, 5 Drawing Sheets

INTAKE DEVICE OF OUTBOARD MOTOR

BACKGROUND OF THE INVENTION

The present invention relates to an intake device of an outboard motor having an improved structure.

An outboard motor is usually used under a relatively clean environment, and accordingly, atmosphere is directly taken as an intake air for an engine of the outboard motor without passing through an air cleaner. The air cleaner is provided with a function of a silencer for reducing noise which is caused at the air intake time, so that the outboard motor is equipped with a silencer for the intake system as intake noise silencing device in place of the location of the air cleaner.

However, in the structure of the engine of the outboard motor provided with no air cleaner, noise generated in the engine is reversely transferred in an (air) intake system and reaches inside the silencer in which the noise is increased, which is undesirable matter.

SUMMARY OF THE INVENTION

The present invention was conceived in view of the problem or defect mentioned above and an object of the present invention is therefore to provide an intake system of an outboard motor having an improved structure for reducing a noise generated in the outboard motor engine.

This and other objects of the present invention can be achieved by providing, in one aspect, an intake device of an outboard motor in which a throttle body is connected to an upstream side of an intake manifold connected to an intake port formed to a cylinder head of an engine and a silencer is connected to an upstream side of the throttle body, wherein a noise reduction device is disposed between a connecting portion of the throttle body and the silencer.

In a preferred embodiment of this aspect, the noise reduction device comprises a baffle plate formed from a plate member so as to provide a hyperbolic curve shape in section. The noise reduction device is provided with an intake opening.

In a more specific aspect, there is provided an intake device of an outboard motor which comprises:

- an intake manifold connected to an intake port of an engine of an outboard motor;
- a throttle body connected to an upstream side of the intake manifold;
- a silencer connected to an upstream side of the throttle body; and
- a noise reduction device disposed to the connecting portion between the throttle body and the silencer.

In a preferred embodiment, the noise reduction device comprises a baffle plate formed from a plate member so as to provide a hyperbolic curve shape in section. A plurality of intake openings are formed to the baffle plate.

Furthermore, an intake tube is disposed upstream side of the throttle body, the throttle body and the silencer are connected with the intake tube being disposed inside the silencer, and the noise reduction device is disposed at an upstream side end of the intake tube. The noise reduction device comprises a baffle plate formed from a plate member so as to provide a hyperbolic curve shape in section and a plurality of intake openings are formed to an outer peripheral surface of the intake tube.

According to the present invention of the characters mentioned above, since the noise reduction device is arranged to the connecting portion of the throttle body and the silencer, the engine noise such as intake pulsation noise can be reduced. Furthermore, the noise reduction device may be composed of a baffle plate formed from a plate member so as to provide a hyperbolic curve shape in section, so that both the noise shielding function and intake function can be achieved at the same time.

The nature and further characteristic features of the present invention will be made clear from the following descriptions made with reference to the accompanying drawings.

DESCRIPTION OF THE PREFERRED EMBODIMENTS

Figure 1:
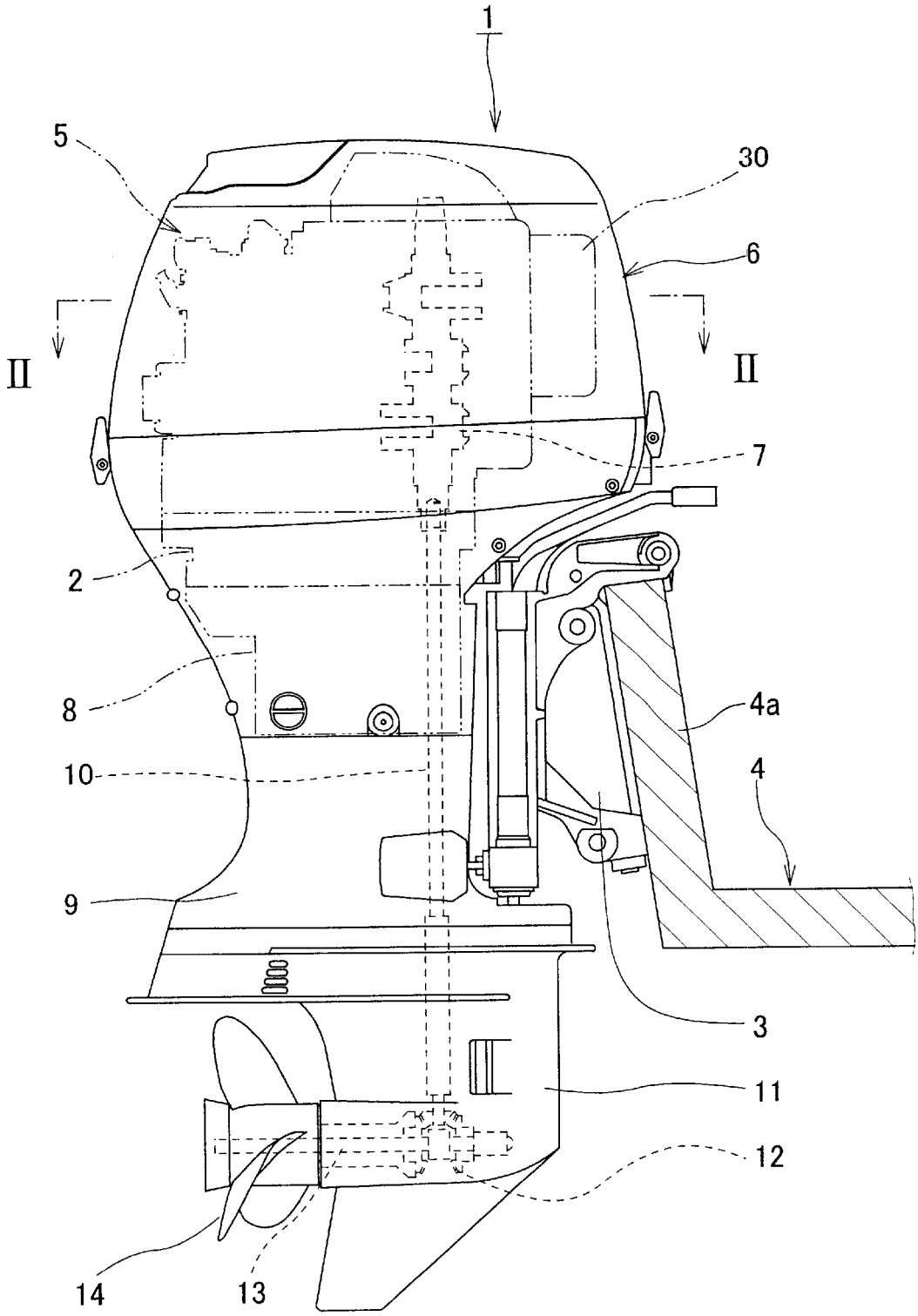
FIG. 1 is a side view of an outboard motor viewed from a right side thereof in a state mounted to a hull, for example.

With reference to FIG. 1, an outboard motor 1 to which the present invention is applicable is shown as a right side view of its standing (mounting) state to a hull, for example.

The outboard motor 1 is provided with an engine 5 which is held by an engine holder 2 and is mounted to a transom 4*a* of a hull 4 through a bracket 3 mounted to the engine holder 2. The engine 5 is disposed above the engine holder 2 and covered by an engine cover 6.

Inside the engine 2, is disposed a crankshaft substantially vertically, and a drive shaft housing 9 is also disposed below the engine holder 2 through an oil pan 8. A drive shaft 10 extends vertically through the inside portions of the oil pan 8 and the drive shaft housing 9 and an upper end portion of the drive shaft 10 is connected to the lower end portion of the crankshaft 7. A gear case 11 is disposed below the drive shaft housing 9, and a propeller 14 is driven, by the operation of the drive shaft 10, through a bevel gear 12 and a propeller shaft 13 arranged inside the gear case 11.

Figure 2:
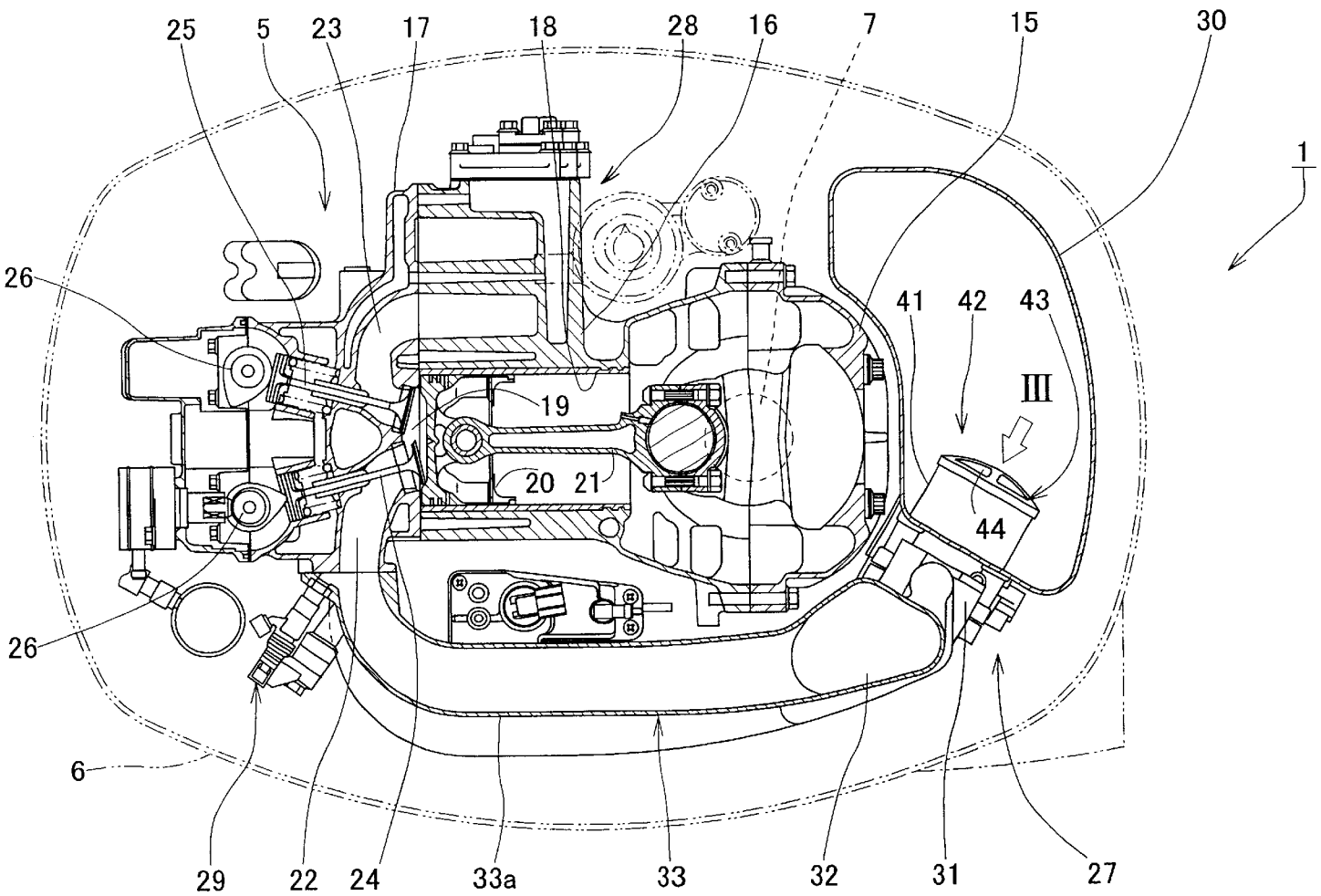
FIG. 2 is a sectional view, of one embodiment of an outboard motor according to the present invention, taken along the line II—II in FIG. 1.

With reference to FIG. 2, being a sectional view of the engine 5 taken along the line II—II in FIG. 1, the first embodiment of the present invention will be described.

Referring to FIG. 2, a crank case 15 is arranged to the most front portion (right side as viewed, i.e. hull side) of the engine, a cylinder block 16: is arranged on a rear side (left side) of the crank case 15 and a cylinder head 17 is also arranged on a rear side (left side) of the cylinder block 16. The crankshaft 7 is arranged in the mating portion of the crank case 15 and the cylinder block 16 so as to extend perpendicularly.

The engine 5 is, for example, a water-cooled four-stroke three-cylinder engine, in which a combustion chamber 19 is disposed to the cylinder head 17 to be aligned with a cylinder (cylinders) 18 horizontally disposed inside the cylinder block 16. A piston 20 is fitted to the cylinder 18 to be horizontally slidable, and the piston 20 is coupled to the crankshaft 7 through a connection rod 21. According to such arrangement, the reciprocal motion (stroke) of the piston 20 is converted into a rotational motion of the crankshaft 7.

There are also formed, in the cylinder head 17, an intake port 22 and an exhaust port 23 which are operatively connected to the combustion chamber 19, and furthermore, an intake valve 24 and an exhaust valve 25 for opening or closing the intake port 22 and the exhaust port 23 are also disposed in the cylinder head 17. A pair of cam shafts 26 to open or close the intake valve 24 and the exhaust valve 25 are disposed behind the cylinder head 17.

Around the engine 5, there are also arranged an intake device 27, an exhaust device 28, a fuel supply device 29, etc. The intake device 27 mainly comprises a silencer 30, a throttle body 31 a surge tank 32 and an intake manifold 33, which are arranged from the front surface side to the right surface side as viewed in the embodiment of FIG. 2. Further, the exhaust device 28 is arranged on the left surface side of the engine 5.

The throttle body 31 is arranged, for example, at an obliquely right forward portion of the crank case 15 and is connected, at its downstream side (left lower side as viewed), with the surge tank 32, from which branch sections 33*a* of the intake manifold 33 extend towards the respective cylinders and are then connected to the intake port 22 formed to the cylinder head 17.

The throttle body 31 is provided, at its upstream side, with an intake tube 41 which is disposed inside the silencer 30. In this state, the throttle body 31 and the silencer 30 are coupled together. A noise insulation device 42 is disposed to the upstream side end of the intake tube 41.

Figure 3:
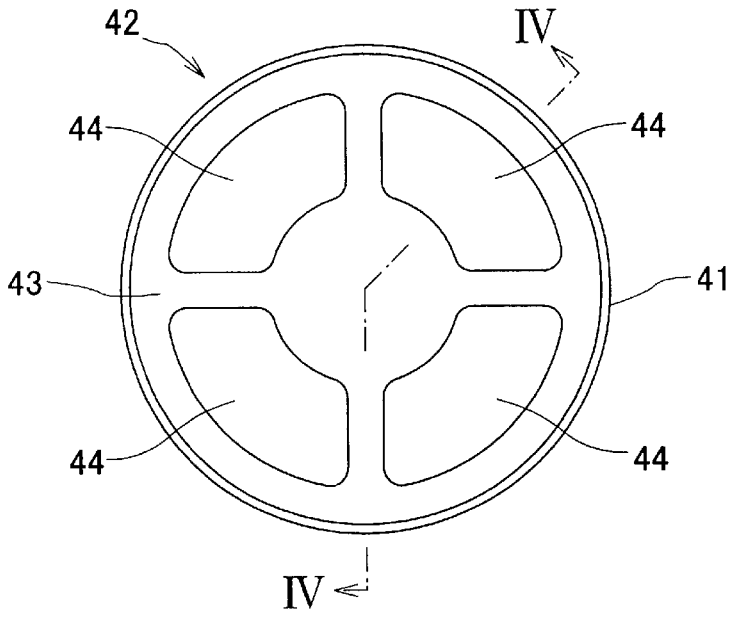
FIG. 3 is a plan view as viewed from a direction III in FIG. 2.
Figure 4:
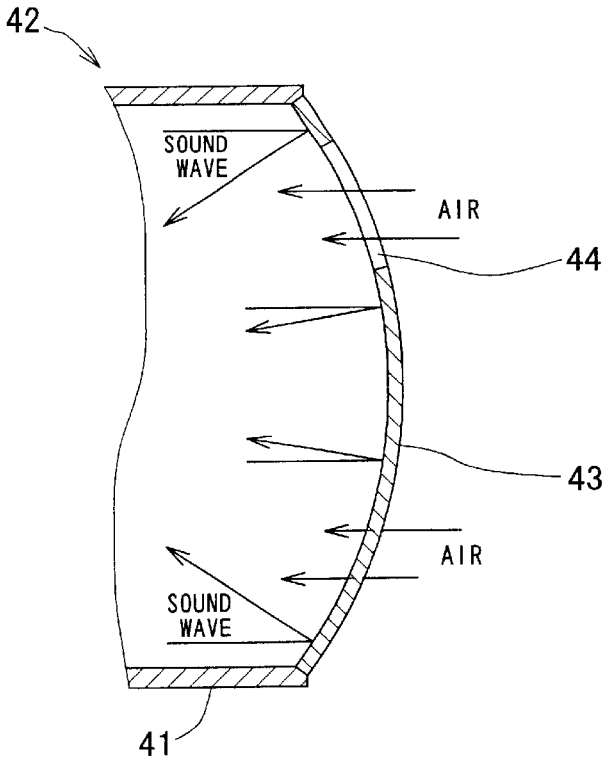
FIG. 4 is a sectional view taken along the line IV—IV in FIG. 3.

Next, with reference to FIGS. 3 and 4, the noise reduction (i.e. insulation) device 42 comprises a baffle plate 43 formed from a plate member such as metal or synthetic resin by bending the same so as to provide a hyperbolic curve in section and the baffle plate 43 is secured to the intake tube 41 so that the radial center thereof, not shown, is positioned inside the intake tube 41. Furthermore, a plurality of intake openings 44 are formed to the surface of the baffle plate 43, and an opening area of each of these openings 44 is set so as not to largely affect on the output power of the engine 5.

Figure 5:
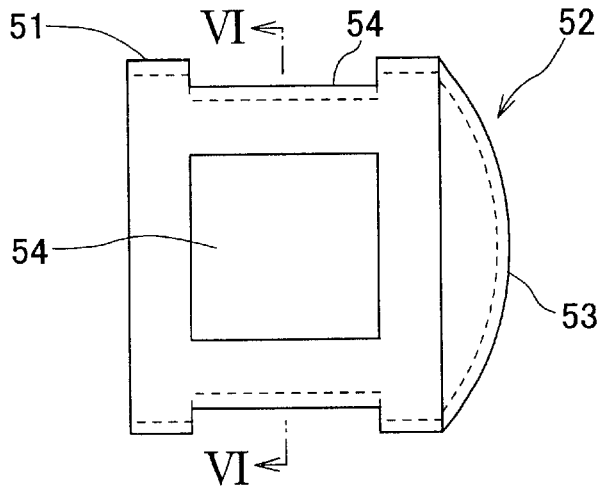
FIG. 5 is a side view of a silencer according to another embodiment of an outboard motor of the present invention.
Figure 6:
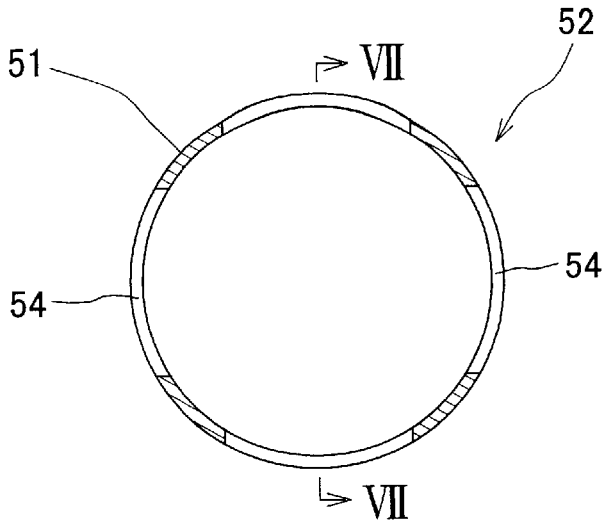
FIG. 6 is a sectional view taken along the line VI—VI in FIG. 5.
Figure 7:
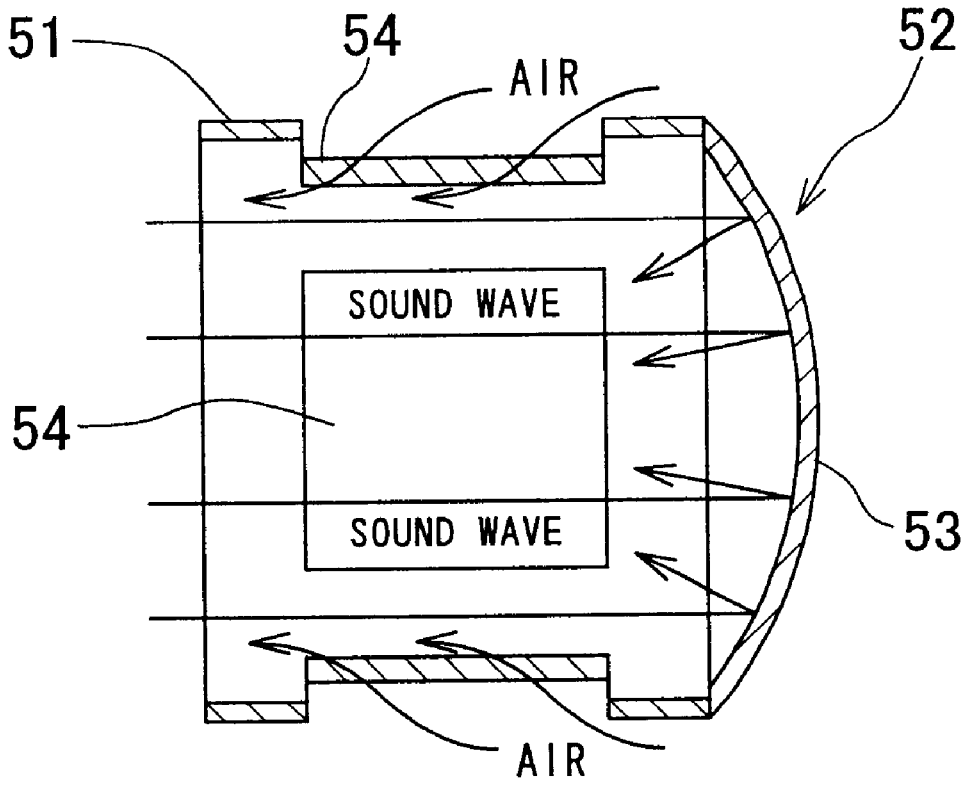
FIG. 7 is a sectional view taken along the line VII—VII in FIG. 6.

FIG. 5 shows another example of the noise reduction device and this noise reduction device 52 comprises an intake tube 51 connected to the throttle body 31 and a baffle plate 53 secured to the upstream side end of the intake tube 51. The baffle plate 53 has a shape similar to the baffle plate 43 of the first mentioned example, but is not formed with intake openings 44, whereas, in this example, a plurality of intake openings 54 are formed to the outer peripheral surface of the intake tube 51. An opening area of each of these openings 54 is set so as also not to largely affect on the output power of the engine 5.

The described embodiment of the present invention will operate or function as follows.

During the operation of the engine 5, noise generated inside the engine 5, for example, particularly, intake pulsation noise, is transferred to the inside of the intake manifold 33 from a portion near the cylinder head 17, then, transferred to the silencer 30 through the throttle body 31 and, finally, discharged externally as engine noise.

In the present invention, since the baffle plate 43 (53) is secured to the intake tube 41 (51), the baffle plate 42 (52) reflects, in the direction of the engine 5, the sound wave of the engine noise which counterflows in the intake tube 41 (51), so that the engine noise is not released externally of the engine.

Furthermore, since the baffle plate 42 (52) has a curved shape so as to provide the hyperbolic curve in section, the rigidity thereof is increased and, moreover, the sound wave can be effectively reflected.

Further, since the rigidity of the baffle plate 43 (53), it becomes possible to form the intake openings 44 to the baffle plate 43 as in the first mentioned example. Since the opening areas of these openings 44 are set so as also not to largely affect on the output power of the engine 5, the opposed functions of the noise reduction (insulation) effect and the intake effect can be together achieved, thus reducing cost, weight and part numbers as well as improving the workability.

Still furthermore, in the baffle plate 52 of the second example, the intake opening 54 are formed to the outer peripheral surface of the intake tube 51, the influence to the output of the engine 5 can be maintained minimum.

It is to be noted that the present invention is not limited to the described embodiment and many other changes and modifications may be made without departing from the scopes of the appended claims.

What is claimed is:

1. An intake device of an outboard motor in which a throttle body is connected to an upstream side of an intake manifold connected to an intake port formed in a cylinder head of an engine and a silencer is connected to an upstream side of the throttle body, wherein a noise reduction device is disposed between a connecting portion of the throttle body and the silencer.

2. An intake device according to claim 1, wherein said noise reduction device comprises a baffle plate formed from a plate member so as to provide a hyperbolic curve shape in section.

3. An intake device according to claim 1, wherein said noise reduction device is provided with an intake opening.

4. An intake device of an outboard motor comprising:

an intake manifold connected to an intake port of an engine of an outboard motor;

a throttle body connected to an upstream side of the intake manifold;

a silencer connected to an upstream side of the throttle body; and a noise reduction device disposed to the connecting portion between the throttle body and the silencer.

5. An intake device according to claim 4, wherein said noise reduction device comprises a baffle plate formed from a plate member so as to provide a hyperbolic curve shape in section.

6. An intake device according to claim 5, wherein a plurality of intake openings is formed in the baffle plate.

7. An intake device according to claim 4, wherein an intake tube is disposed on the upstream side of the throttle body, said throttle body and said silencer are connected with the intake tube being disposed inside the silencer, and said noise reduction device is disposed at an upstream side end of the intake tube.

8. An intake device according to claim 7, wherein said noise reduction device comprises a baffle plate formed from a plate member so as to provide a hyperbolic curve shape in section and a plurality of intake openings is formed in an outer peripheral surface of the intake tube.

* * * * *